US006883580B1

(12) United States Patent
Donahue et al.

(10) Patent No.: US 6,883,580 B1
(45) **Date of Patent: *Apr. 26, 2005**

(54) APPARATUS AND IMPROVED METHOD FOR LOST FOAM CASTING OF METAL ARTICLES USING EXTERNAL PRESSURE

(75) Inventors: Raymond J. Donahue, Fond du Lac, WI (US); Terrance M. Cleary, Fond du Lac, WI (US)

(73) Assignee: Brunswick Corporation, Fond du Lac, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/351,785

(22) Filed: Jan. 27, 2003

(51) Int. Cl.[7] ..... B22C 9/04
(52) U.S. Cl. ..... 164/34; 164/235; 164/246
(58) Field of Search ..... 164/34, 235, 246

(56) References Cited

U.S. PATENT DOCUMENTS

| | | | | |
|---|---|---|---|---|
| 4,240,493 | A | 12/1980 | Wilmarth | 164/35 |
| 4,300,617 | A | 11/1981 | Bauer | 164/244 |
| 4,854,368 | A | 8/1989 | Vezirian | 164/34 |
| 4,966,220 | A | 10/1990 | Hesterberg et al. | 164/34 |
| 5,014,764 | A | 5/1991 | Garat | 164/34 |
| 5,058,653 | A | 10/1991 | Garat | 164/34 |
| 5,088,544 | A | 2/1992 | Garat | 164/34 |
| 5,161,595 | A | 11/1992 | Garat | 164/34 |
| 5,290,373 | A | 3/1994 | Donahue et al. | 148/549 |
| 5,335,711 | A | 8/1994 | Paine | 164/66.1 |
| 5,941,297 | A | 8/1999 | Young | 164/62 |
| 5,954,113 | A | 9/1999 | Buchborn | 164/61 |
| 5,960,851 | A | 10/1999 | Donahue | 164/34 |
| 6,024,157 | A | 2/2000 | Donahue et al. | 164/34 |

FOREIGN PATENT DOCUMENTS

JP 2-25241 * 1/1990

OTHER PUBLICATIONS

Web Site, www.eng.uab.edu/mte/about/research/xray, UAB Casting Engineering Laboratory, Feb., 2002.

* cited by examiner

*Primary Examiner*—Kuang Y. Lin
(74) *Attorney, Agent, or Firm*—Andrus, Sceales, Starke & Sawall, LLP

(57) ABSTRACT

An apparatus and method to delay the application of pressure on a molten metal front to equalize a pressure gradient present at the molten metal front during pressurized lost foam casting processes, or other pressurized casting processes. A pressure equalization member is placed over a pouring cup to divert the direct application of pressure to molten metal present in the pouring cup. The pressure equalization member allows for increased pressurization rates in such processes, facilitating interdendritic feeding while reducing microporosity and metal penetration defects.

19 Claims, 1 Drawing Sheet

APPARATUS AND IMPROVED METHOD FOR LOST FOAM CASTING OF METAL ARTICLES USING EXTERNAL PRESSURE

BACKGROUND OF THE INVENTION

In lost foam or evaporable foam casting, a pattern is produced from a polymeric foam material, such as polystyrene, and has a configuration identical to the metal article to be cast. A porous ceramic coating is applied to the outer surface of the pattern. One or more patterns may be located within an outer mold or flask, where a polymeric foam gating system connects the pattern to a sprue. The space between the pattern or and the flask is filled with a finely divided inert material, such as sand, and the material also fills the internal cavities within the pattern.

In the lost foam casting process, molten metal is fed from a pouring cup into the sprue and the heat of the molten metal decomposes the polymeric foam material of the gating system, as well as the pattern. The molten metal occupies the void created by the decomposition of the foam material and the products of the foam decomposition pass through the porous ceramic coating on the pattern and become trapped within the interstices of the sand. In practice, when casting large objects such as engine blocks, and when utilizing 5 to 50 atmospheres of pressure, it takes approximately 30–60 seconds for the molten metal to decompose and occupy the polymeric foam pattern. When the molten metal solidifies, the resulting cast article has a configuration identical to the polymeric foam pattern.

It is recognized in the art that the application of external pressure to the molten metal before solidification is completed aids in the interdendritic feeding of the molten metal during solidification and prevents both the precipitation of hydrogen porosity and the formation of microporosity in the final product. This pressurization is commonly accomplished by placing the flask and its content, including the pouring cup, into an outer pressure vessel.

However, in the current state of the art, pressurization of the flask contents is closely controlled. This is done because too rapid of a pressurization rate leads to failure of the ceramic coating. When the ceramic coating fails, metal penetration defects appear in the cast product. The failure results from the occurrence of a large pressure gradient across the molten metal front that appears upon the sudden application of pressure. For example, when pressure is suddenly applied to the vessel, the pressure in the liquid metal rises rapidly. The velocity at which the pressure rises in the metal is at the speed of sound in liquid metal. At the same time, it is recognized that the pressure rise in the finely divided inert material is dependent upon the size and shape of the material utilized. Generally, the rise in pressure in the liquid metal is much faster than the rise in pressure in the finely divided inert material. This disparity in rate of pressure application causes a pressure gradient to appear across the molten metal front. If the pressure differential of the pressure gradient exceeds a threshold value when the molten metal front reaches the ceramic coating, then the ceramic coating will fail. When the ceramic coating fails, metal penetration of the coating results, and the casting finish takes on the surface of the sand.

Conversely, if the pressurization rate of the vessel is slow, the benefits of applying the pressure may not be realized in all portions of the casting. Thus, the casting would not see the benefits of reduction in gas porosity due to hydrogen precipitation, improved delivery during the initial stages of solidification and improved interdendritic feeding during the last stages of solidification.

Another drawback of traditional pressure application methods is that the proper application of pressure requires a very narrow processing window. This results in limitation on pressurization rates, limitations on the size and distribution of the finely divided inert material, and often results in unacceptable cast products that are scrapped. Furthermore, the narrow process window creates restrictions on manufacturing processes that create inefficiencies.

SUMMARY OF THE INVENTION

As aforementioned, the application of external pressure in lost foam casting processes aids in the interdendritic feeding of the molten metal during solidification. However, traditional methods require a very narrow process window limiting the pressurization rates and creating restrictions on manufacturing processes which in turn create inefficiency in the industrial processes in which lost foam casting methods are applied.

An increase in the pressurization rate exacerbates metal penetration defects because the applied pressure reaches the molten metal front first through the molten metal, and then later through the finely divided inert material, ceramic coating and foam pattern. This creates a pressure gradient across the molten metal front resulting in significant metal penetration defects, especially with rapid pressurization rates. Therefore, in order to allow more rapid pressurization rates, the molten metal front must be stabilized throughout pressurization.

The present invention surprisingly found that the incorporation of a pressure equalization member in association with the pouring cup efficiently equalizes the pressure at the molten metal front and allows for increased pressurization rates without metal penetration defects, as occurred in the past.

DESCRIPTION OF THE DRAWINGS

The drawing illustrates the best mode presently contemplated of carrying out the invention.

In the drawing.

DETAILED DESCRIPTION

Figure 1:
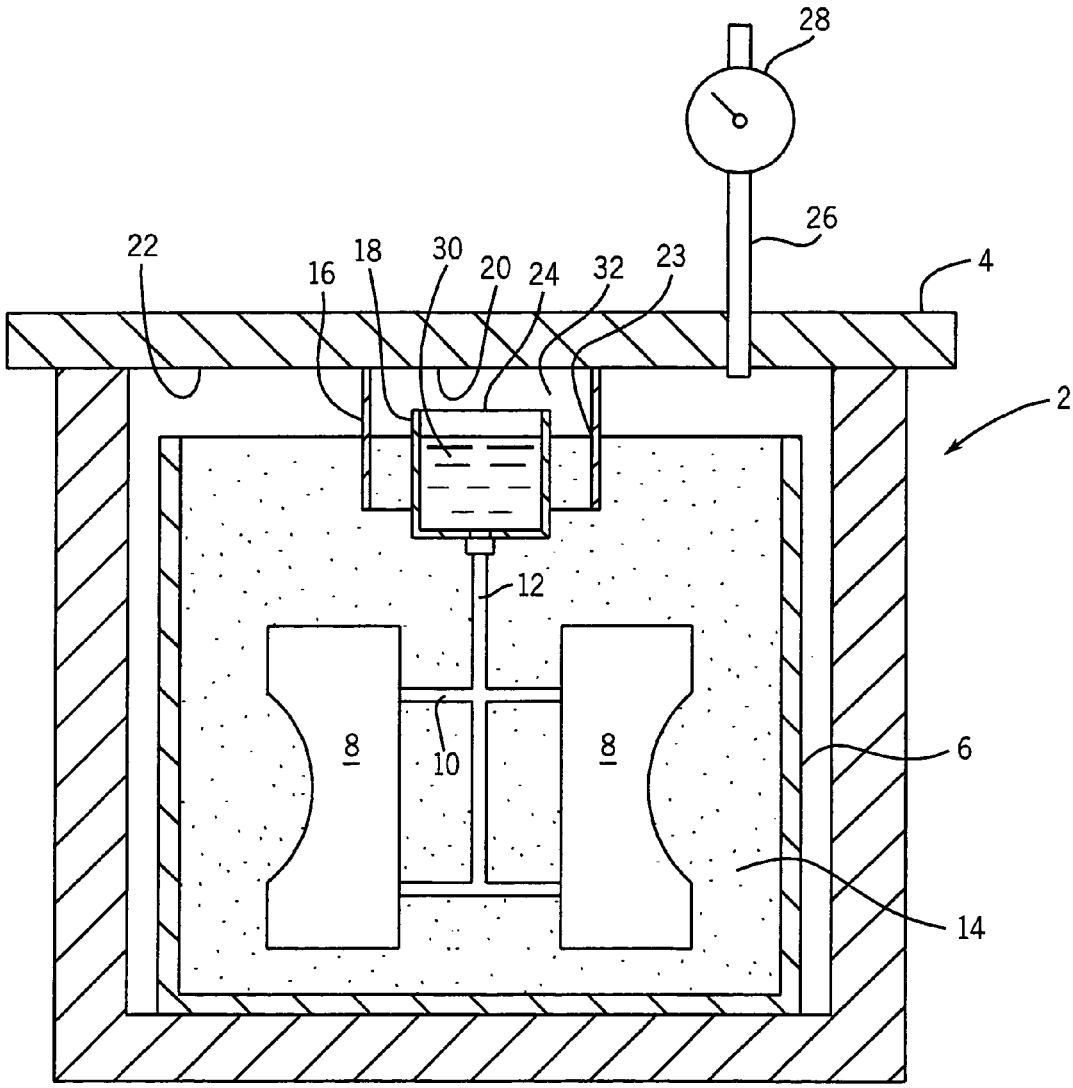
FIG. 1 is a vertical section of an apparatus that can be used to carry out the method of the invention.

The drawing illustrates an apparatus that can be used in carrying out the casting method of the invention. The apparatus includes a pressure vessel 2 with an open end enclosed by a hinged lid 4. In practice, the lid 4 may be hinged to the pressure vessel 2 and moved between an open and closed position by mechanical equipment (not shown). When casting relatively large objects, such as engine blocks or internal combustion engines, the pressure vessel may be of substantial size, for example, about 36 inches in diameter and 42 inches high.

In the casting process, a metal, generally cylindrical, open top mold or flask 6 is positioned in pressure vessel 2 and one or more ceramic coated patterns 8 formed of a polymeric foam material, such as polystyrene, are located in the flask 6. Each pattern 8 has a configuration corresponding to the article to be cast. Patterns 8 are connected through a gating 10 to a sprue 12. The gating 10 and sprue 12 are also formed of polymeric foam material. A pouring cup 18, preferably formed of non-porous ceramic fiber material, is located at the upper end of the flask 6 and communicates with the sprue 12.

Surrounding the pattern 8 and gating 10 in the flask 6 is a finely divided inert material 14, such as silica sand or other similar material. The finely divided inert material 14 also fills any voids or cavities present in the pattern 8.

As a feature of the invention, a cup-shaped pressure equalization member 16 is placed within the lid 4 of the pressure vessel 2. The base 20 of the pressure equalization member 16 is attached to the undersurface 22 of the lid 4. The surface area of the pressure equalization member 16 is greater than the surface area of the pouring cup 18. The shape of the pressure equalization member 16 is directly related to the shape of the pouring cup 18 and therefore may vary with the shape of the pouring cup. In the illustrated embodiment, the pressure equalization member is constructed of non-porous, high temperature ceramic material, but may be constructed of other comparable materials.

In a method of the invention, the pouring cup 18 is attached to the sprue 12 and the finely divided inert material 14 fills the flask 6 to a level approximately halfway to the top of the pouring cup 18. A gas pressure line 26 is mounted within an opening in lid 4 and connects a suitable source of compressed air or an inert gas, such as nitrogen or argon, to the interior of the pressure vessel 2. A pressure gauge 28 may be mounted in line 26. Alternately, pressure line 26 may be connected through the side wall of the pressure vessel 2.

In carrying out of the process of the invention, after the inert material 14 fills the flask 6 to the desired level, the inert material is compacted by conventional methods using vertical compaction. With the lid 2 in the open position and the pouring cup 18 connected to the sprue 12, a molten metal 30, which may be an aluminum silicon alloy, a magnesium alloy, stainless steel or the like, is subsequently poured into the pouring cup 18 and the lid 4 is moved to the closed and sealed position.

As the lid 4 is pivoted to the closed and sealed position, the pressure equalization member 16 is correspondingly moved over the pouring cup 18. The side wall 23 of the pressure equalization member 16 surrounds, and is spaced outwardly of, the pouring cup 18 and a lower edge 34 of the side wall 23 is embedded in the inert material 14. As the pressure equalization member 16 is larger than the pouring cup 18, an annular, pressurized compartment head section 32 is formed between the sub-member 16 and the pouring cup 18. After the pressure vessel 2 is sealed, pressure, preferably in the range of 5 to 50 atmospheres, is applied to the contents of the flask 6 through the pressure line 26. When pressure is applied, the pressure must travel down into the finely divided inert material 14 and back up into the pressurized compartment head section 32 in order to reach the molten metal 30.

The molten metal 30 poured into the pouring cup 18 is generally at a temperature greater than 1250° Fahrenheit and the heat of the molten metal will melt, vaporize and decompose in various fractions the polymeric structures 8, 10 and 12 present in the flask 6. The molten metal 30 first decomposes the sprue 12 and gating 10, with the resulting decomposition products passing through the porous ceramic coating present on such structures and into the interstices of the finely divided inert material 14. As the molten metal occupies the void created by the vaporization of the polymeric foam material, the molten metal front progressively moves through the gating 10 and into the pattern 8. Similarly, as the molten metal front moves into the pattern 8, the polymeric material of the pattern melts, vaporizes and decomposes. The byproducts of decomposition pass through the porous ceramic coating on the pattern and into the interstices of the surrounding finely divided inert material 14. In this manner, the molten metal 30 fills the void created by decomposition of the pattern 8 to produce a casting identical in configuration to the pattern 8. In practice, when casting engine blocks and utilizing 10 ATM of pressure, it takes approximately 30–60 seconds for the molten metal 30 to decompose the pattern 8.

The presence of the sub-member 16 creates an equilibrium between the application of the pressure to the molten metal 30 through the finely divided inert material 14, and the application of pressure applied to the molten metal 30. Without the presence of the pressure equalization member 16, pressure would be directly applied to the molten metal 30 present in the pouring cup 18. Concomitantly, with or without the sub-member 16, pressure is applied to the molten metal front from a second direction, through the finely divided inert material 14, the porous ceramic coating, and pattern 8. The finely divided inert material 14 creates a tortious path to the molten metal front, creating a lag time in the application of pressure to the molten metal front from this second direction. Therefore, a differential pressure gradient occurs across the molten metal front during pressurization when the pressure application through the first path is not regulated. As previously described, such differential pressure is undesirable as it results in metal penetration defects. With the presence of the sub-member 16, the differential pressure is avoided as the first path to the molten metal front is regulated.

The differential pressure gradient is avoided with the presence of the sub-member 16 because the pressure equalization member 16 forces the pressure that would be directly applied to the molten metal 30 to travel through the tortious pathway through the inert material 14 and around the lower edge of the member 16, and thus creates a delay in application of pressure to the molten metal 30. In order for the pressure to reach the molten metal, the pressure must travel both: (a) through the inert material 14 and across the ceramic coating on pattern 8; and (b) down through the inert material 14, up into the pressurized compartment head section 32 and thereinto the molten metal 30. In this manner, the application of pressure to the molten metal 30 occurs at relatively the same time, resulting in the significant reduction of pressure differential at the molten metal front. Therefore, the presence of the permeable sub-member advantageously allows for an increased pressurization rate while avoiding the development of a differential pressure at the molten metal front that would result in metal penetration defects.

The invention has a further advantage in the fact that the pressure equalization member is reusable. Thus, a new pressure equalization member need not be inserted after every casting.

In another embodiment, the pressure equalization member 16 may be constructed of a selectively permeable material, the permeability being equivalent to the permeability of the finely divided inert material 14. The selectively permeable material may be a porous high temperature ceramic material, or the like. In this embodiment, the molten metal front is stabilized as the pressure traveling through the pressure equalization member 16 is forced to travel at the same rate as the pressure traveling through the finely divided inert material 14.

In still another embodiment of the invention, the pressure equalization member 16 is constructed of impermeable material, while the pouring cup 18 is constructed of a selectively permeable material, the permeability of the material matching the permeability of the finely divided inert material 14. The selectively permeable material may be a porous high temperature ceramic material, or the like. In this embodiment, the sub-member 16 would fit directly onto the pouring cup 18 and close off the upper end of the cup, and the molten metal front would be stabilized as the pressure application to the molten metal 30 would travel through the selected permeability pouring cup 18 at the same rate as it travels through the finely divided inert material 14 and subsequently through the ceramic coating.

It is further understood that the present invention is applicable to lost foam casting processes which (1) apply pressure after the polymeric pattern 8 is fully decomposed, and to processes which (2) incorporate large volume pouring cups in order to apply pressure before the polymeric foam pattern 8 is fully ablated. In both circumstances, the presence of the sub-member 16, in any of the embodiments described above, operates to equalize pressure at the molten metal front when the molten metal front reaches the porous ceramic coating of the polymeric foam pattern.

The above description describes what is believed to be the preferred embodiments of the present invention. It is contemplated that numerous other pressure equalization members may be utilized in accordance with this invention. For instance, the pressure equalization member may be constructed to effectively seal the pouring cup, with the pressure equalization member being constructed of a permeable high temperature ceramic material having the same permeability as the inert material used to fill the flask. In this manner the pressure equalization member would be of a shape other than cup-like, such as disc-like. However, those skilled in the art will recognize that other and further changes and modifications may be made thereto without departing from the spirit and scope of the invention, and is intended to claim all such changes and modifications which fall within the true scope of the invention.

We claim:

1. A method of lost foam casting comprising the steps of positioning a polymeric foam pattern corresponding in configuration to an article to be cast in a vessel, connecting a polymeric foam gating system to the pattern in the vessel, introducing a finely divided inert material into the vessel to surround the pattern and the gating system and to fill internal cavities in the pattern, positioning a pouring cup in the vessel, connecting said pouring cup with said gating system, pouring a molten metal into the pouring cup, the molten metal providing a molten metal front to decompose the gating system and pattern with the molten metal filling the void created by decomposition of the polymeric foam material and the products of decomposition passing into the interstices of the finely divided material, sealing the pressure vessel with the pouring cup retained within said vessel, wherein a pressure equalization member is positioned over the pouring cup and in contact with the inert material, applying an external super atmospheric pressure to the inert material in the vessel and to the molten metal in the pouring cup, equalizing the pressure gradient at the molten metal front, by forcing the applied pressure to travel through said inert material and said pressure equalization member before application to the molten metal, and maintaining said pressure on said inert material and said molten metal until the molten metal solidifies to produce a cast article corresponding in configuration to the pattern.

2. The method of claim 1, wherein the step of equalizing the pressure gradient comprises positioning an inverted cup-shaped pressure equalization member in the vessel over the pouring cup and spacing the member outwardly of the cup to provide a space there between, and contacting a lower edge of the member with the inert material.

3. The method of claim 2, and including the step of constructing the pressure equalization member of a non-porous material, whereby the pressure is transmitted into said inert material and through said space to the molten metal in the pouring cup.

4. The method of claim 2, and including the step of constructing the pressure equalization member of a permeable material, whereby the pressure is transmitted through the permeable material to the space and to the molten metal in the pouring cup.

5. The method of claim 1, wherein the step of equalizing the pressure gradient comprises positioning a pressure equalization member formed of a permeable material over the molten metal in the pouring cup.

6. The method of claim 4, and further comprising the step of providing the permeable material with a permeability substantially equivalent to the permeability of the insert material.

7. The method of claim 1, wherein the step of applying external pressure comprises applying external pressure immediately after the pouring cup is filled.

8. The method of claim 1, wherein the step of connecting the pouring cup further comprises connecting a pouring cup having a volume in the range of 25%–75% of the combined volume of the pattern and gating system.

9. The method of claim 1, wherein the step of applying external pressure comprises applying external pressure after the pattern and gating system are fully decomposed by the molten metal.

10. The method of claim 1, wherein the step of applying the external pressure comprises applying external pressure in the range of 5–60 atmospheres.

11. The method of claim 5, and further comprising the step of providing the permeable material with a permeability substantially equivalent to the permeability of the insert material.

12. The method of claim 1, wherein the pressure equalization member is fixedly connected to a cover of the vessel.

13. An apparatus for lost foam casting, comprising a closed vessel, a polymeric foam pattern corresponding in configuration to an article to be cast and disposed in said vessel, a polymeric foam gating system connected to the pattern, a finely divided inert material surrounding the pattern and said gating system and filling internal cavities in the pattern, a pouring cup disposed in the vessel and communicating with the gating system, a molten metal disposed in the pouring cup and providing a molten metal front to decompose the gating system and the pattern with the molten metal filling the void created by decomposition of the polymeric foam with the products of decomposition passing into the interstices of the finely divided material, means for applying a super atmospheric pressure to the inert material and to the molten metal in the pouring cup, and a pressure equalization member that equalizes the pressure gradient at the molten metal front, wherein the pressure equalization member is fixedly connected to a cover of the vessel.

14. The apparatus of claim 13, wherein the pressure equalization member comprises an inverted cup-shaped member disposed over the pouring cup and spaced outwardly of the pouring cup to provide a space therebetween, said cup-shaped member having a lower edge disposed in contact with the inert material.

15. The apparatus of claim 14, wherein said cup-shaped member has a section composed of a permeable material, and said pressure is transmitted through said section to said space and then to the molten metal in the pouring cup.

16. The apparatus of claim 14, wherein said cup-shaped member is composed of a non-permeable material and said pressure is transmitted into said inert material and through said space to the molten metal in the pouring cup.

17. The apparatus of claim 13, wherein the pressure equalization member comprises a permeable pressure equalization member disposed over the molten metal in the pouring cup.

18. The apparatus of claim 17, wherein the pressure equalization member has a permeability substantially equivalent to the permeability of the inert material.

19. The apparatus of claim 13, wherein said vessel has a removable cover and said pressure equalization member is fixedly connected to the base of said cover.

* * * * *